US009802084B2

(12) United States Patent
Shimahara et al.

(10) Patent No.: US 9,802,084 B2
(45) Date of Patent: Oct. 31, 2017

(54) GOLF CLUB HEAD

(71) Applicant: Dunlop Sports Co. Ltd., Kobe-shi, Hyogo (JP)

(72) Inventors: Yuki Shimahara, Kobe (JP); Naruhiro Mizutani, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/239,181

(22) Filed: Aug. 17, 2016

(65) Prior Publication Data

US 2017/0050091 A1 Feb. 23, 2017

(30) Foreign Application Priority Data

Aug. 18, 2015 (JP) ..... 2015-160770

(51) Int. Cl.
*A63B 53/04* (2015.01)
*A63B 53/06* (2015.01)

(52) U.S. Cl.
CPC ..... *A63B 53/04* (2013.01); *A63B 53/0466* (2013.01); *A63B 2053/0416* (2013.01); *A63B 2053/0433* (2013.01); *A63B 2053/0491* (2013.01)

(58) Field of Classification Search
CPC ..... A63B 53/04; A63B 53/0466; A63B 2053/0416; A63B 2053/0491; A63B 2053/0433
USPC ..... 473/324–350, 287–292
See application file for complete search history.

(56) References Cited

U.S. PATENT DOCUMENTS 5,447,309 A * 9/1995 Vincent ..... A63B 53/04 473/335
5,916,042 A * 6/1999 Reimers ..... A63B 53/04 473/334
6,089,994 A * 7/2000 Sun ..... A63B 53/04 473/338
6,254,494 B1 * 7/2001 Hasebe ..... A63B 53/04 473/345
7,108,609 B2 * 9/2006 Stites ..... A63B 53/06 473/256
7,153,220 B2 * 12/2006 Lo ..... A63B 53/0466 473/335
7,824,280 B2 * 11/2010 Yokota ..... A63B 53/0466 473/334

(Continued)

FOREIGN PATENT DOCUMENTS

JP 2009-112570 A 5/2009
JP 2011-005166 A 1/2011

*Primary Examiner* — Sebastiano Passaniti
(74) *Attorney, Agent, or Firm* — Birch, Stewart, Kolasch & Birch, LLP

(57) ABSTRACT

A golf club head comprises: a head main body having a hollow therein; a weight member disposed in the hollow and extending from its first end to its second end; a first end side portion of the weight member is secured to a first position of the head main body rotatably around a first axis at the first position so that a second end side portion of the weight member is movable to at least a second position and a third position of the head main body which positions are on a locus described by the first end side portion of the weight member during rotating about said first axis; and a fastener for fixing the second end side portion of the weight member to any of said at least second and third positions of the head main body.

13 Claims, 12 Drawing Sheets

(56) References Cited

U.S. PATENT DOCUMENTS

| | | | | |
|---|---|---|---|---|
| 8,790,195 | B1 * | 7/2014 | Myers | A63B 53/0466 473/335 |
| 9,381,410 | B2 * | 7/2016 | Golden | A63B 53/0466 |
| 2006/0122004 | A1 * | 6/2006 | Chen | A63B 53/0466 473/335 |
| 2006/0240907 | A1 * | 10/2006 | Latiri | A63B 53/0466 473/334 |
| 2009/0118034 | A1 | 5/2009 | Yokota | |
| 2010/0105499 | A1 * | 4/2010 | Roach | A63B 53/0466 473/335 |
| 2010/0331103 | A1 * | 12/2010 | Takahashi | A63B 53/0466 473/338 |

* cited by examiner

GOLF CLUB HEAD

TECHNICAL FIELD

The present invention relates to a golf club head, and more particularly to a structure capable of adjusting the position of the center of gravity of the head.

BACKGROUND ART

In recent years, golf club heads capable of adjusting the position of the center of gravity of the head have been proposed, for example, in the following Patent Documents 1 and 2.

Patent Document 1: Japanese Patent Application Publication No. 2009-112570

Patent Document 2: Japanese Patent Application Publication No. 2011-5166

SUMMARY OF THE INVENTION

Problems to be Solved by the Invention

In the golf club heads disclosed in the Patent documents 1 and 2, a weight member is attached to the outer side of the head. In such a golf club head, the movable range of the weight member is restricted by the contour shape of the head, and thereby, the adjustable range of the position of the center of gravity is not so large. Further, a weight member attached to the outer surface of the sole portion of the head may degrade the appearance of the sole.

The present invention was therefore, made in light of the circumstances described above, and a primary object of the present invention is to provide a golf club head, in which the position of the center of gravity of the head can be widely changed.

Means for Solving the Problems

According to the present invention, a golf club head having a face for striking a ball, comprises:

a head main body having a hollow therein, a weight member disposed in the hollow and extending from its first end to its second end, wherein a first end side portion of the weight member is secured to a first position of the head main body rotatably around a first axis at the first position so that a second end side portion of the weight member is movable to at least a second position and a third position of the head main body which positions are on a locus described by the first end side portion of the weight member during rotating about said first axis, and a fastener for fixing the second end side portion of the weight member to any of said at least second and third positions of the head main body.

Further, the golf club head according to the present invention may have the following features (1)-(7):

(1) the weight member is fixed to a sole portion which defines a bottom surface of the head main body;

(2) the first axis intersects the sole portion;

(3) the fastener is a screw capable of being tightened and loosened from the outside of the head at each of said at least second and third positions;

(4) in the front-back direction of the head, the third position is located at the rear of the second position;

(5) in the toe-heel direction of the head, the first position is located on the toe side of the third position, and the second position is located on the heel side of the third position;

(6) in the toe-heel direction of the head, the first position is located on the toe side of the third position, and the second position is located on the heel side of the third position;

(7) when the second end side portion is fixed to the second position, the longitudinal direction of the weight member lies in a direction along the face.

Therefore, in the golf club head according to the present invention, by rotating the rod-shaped weight member around the first axis with the center of rotation set in a first end portion of the rod-shaped weight member, the center of gravity of the weight member can be moved largely within the internal space of the head. Accordingly, it is possible to adjust the position of the center of gravity of the golf club head over a wide range. Further, since the weight member is disposed within the internal space of the head main body, it is possible to minimize the adverse effect on the appearance of the sole.

DESCRIPTION OF THE PREFERRED EMBODIMENTS

Figure 1:
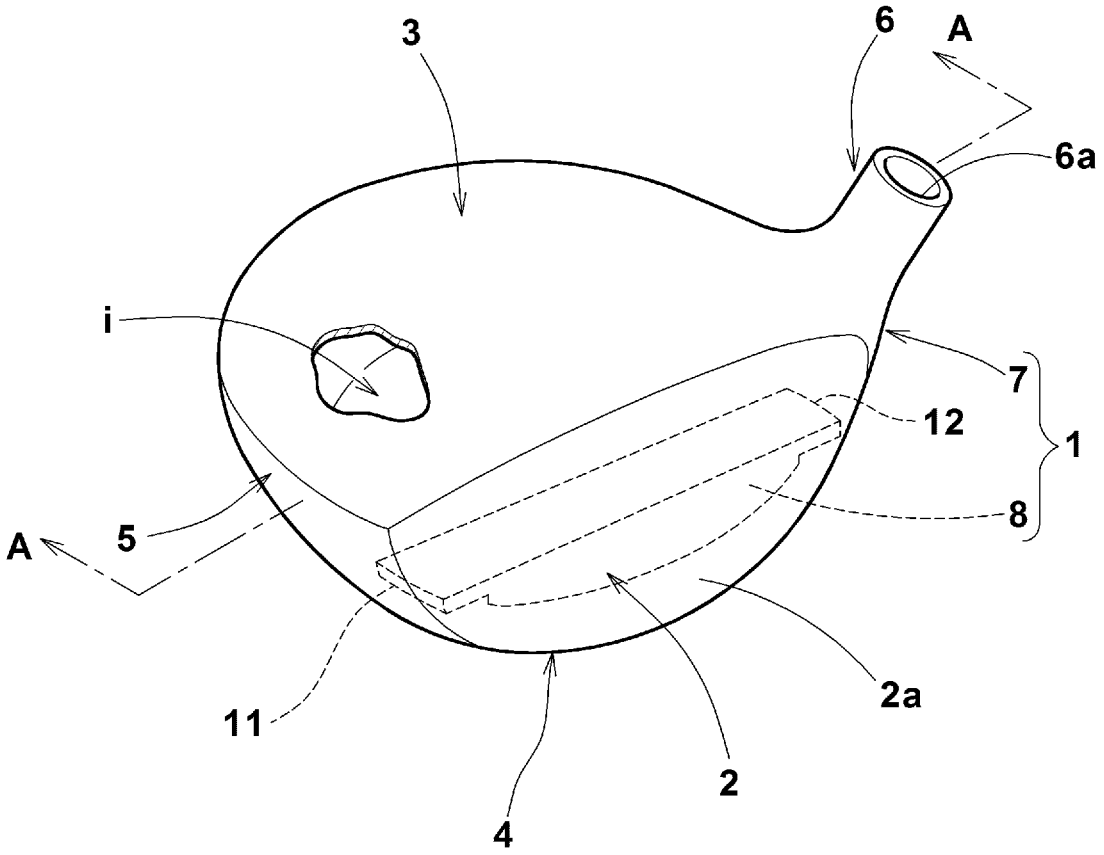
FIG. 1 is a perspective view of a golf club head as an embodiment of the present invention.

Embodiments of present invention will now be described in detail in conjunction with accompanying drawings, wherein the same reference numerals are used for the same or common elements of different embodiments, and redundant overlapping descriptions are omitted.

In FIG. 1, a golf club head 1 as an embodiment of the present invention comprises a face portion 2, a crown portion 3, a sole portion 4, and a side portion 5 to define a hollow (i) within the head 1.

In FIGS. 1 to 4, the head 1 is shown as its standard state.

Here, the standard state is such that the head is set on a horizontal plane HP at a lie angle and a loft angle which are specified for the head.

Unless otherwise noted, the head 1 is assumed to be set in the standard state.

The face portion 2 has a face 2*a* as a surface for striking a ball.

The crown portion 3 is continued from the face portion 2 to form an upper surface of the head.

The sole portion 4 is continued from the face portion 2 to form a bottom surface of the head.

The side portion 5 connects between the crown portion 3 and the sole part 4.

The toe side end and the heel side end of the side portion 5 are connected to the face portion 2.

The crown portion 3 is provided in its heel side portion with a hosel portion 6.

The hosel 6 is tubular, and has a shaft inserting hole 6*a* into which the tip end of a club shaft (not shown) can be fixed.

The central axis of the shaft insertion hole 6*a* corresponds to the central axis of the club shaft, therefore, when setting the club head 1 alone to its lie angle, the central axis of the shaft insertion hole 6*a* can be used instead of the central axis of the club shaft.

The head 1 in this embodiment is of a wood type. The wood type means at least Driver (#1), Brassie (#2), spoon (#3), Buffy (#4) and Cleek (#5). In addition to the above, wood type heads include heads having similar shapes to those of the heads listed above even if the club number and name are different from the above.

As another embodiment, the head 1 may be configured as a utility-type head. Further, it may be configured as an iron-type head as far as it has a hollow structure.

Figure 3:
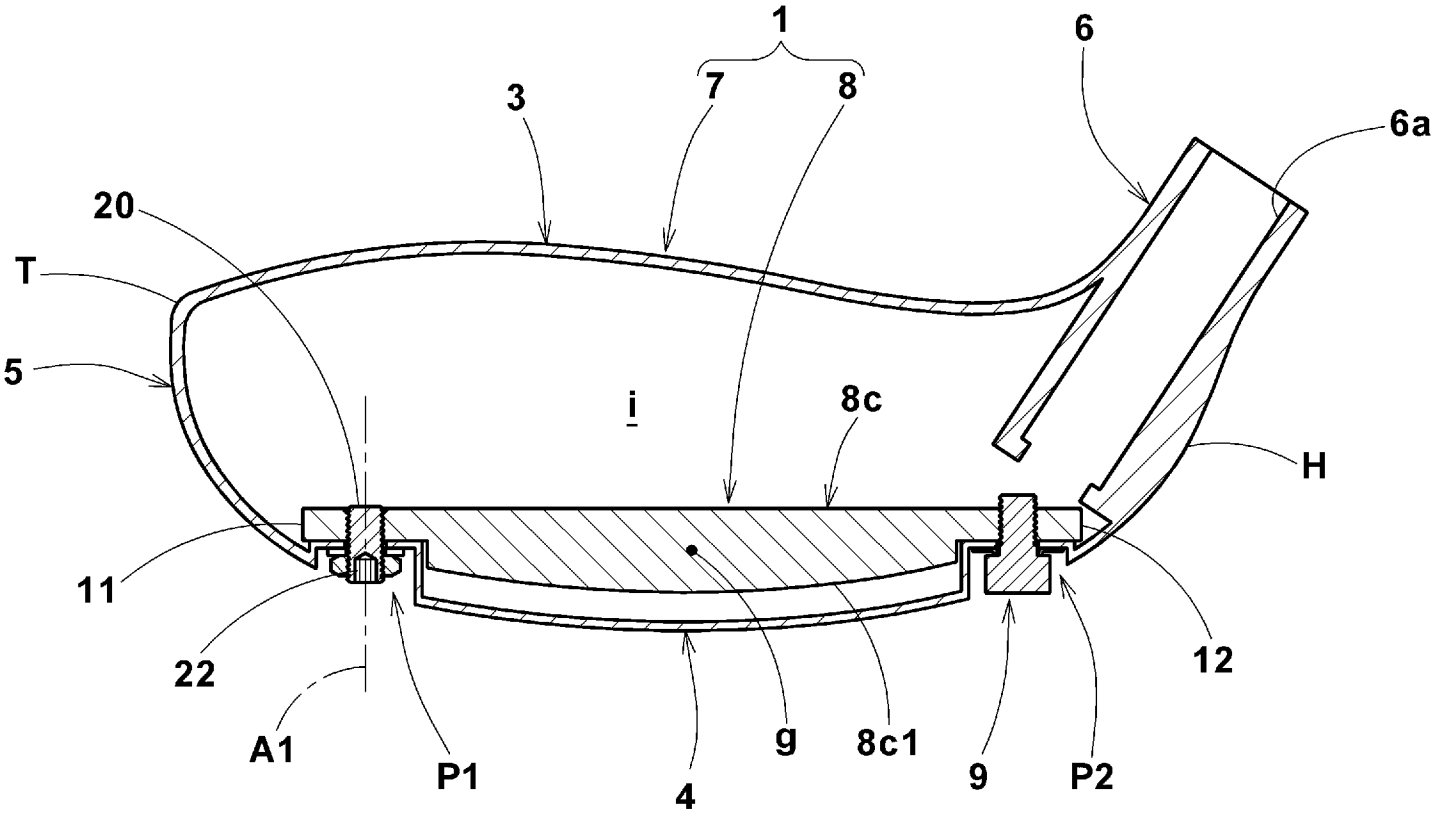
FIG. 3 is a sectional view of the golf club head taken along a vertical plane (A-A in FIG. 1).

As shown in FIG. 3, the head 1 in this embodiment comprises a head main body 7 with the hollow (i) therein, and a weight member 8 disposed in the hollow (i).

The head main body 7 includes the face portion 2, the crown portion 3, the sole portion 4, the side portion 5 and the hosel portion 6 which constitute an outer shell part of the head enclosing the hollow (i).

For example, the head main body 7 is made of a metallic material. As the metal material, for example, stainless steel, maraging steel, titanium alloy, magnesium alloy or aluminum alloy can be used. It is also possible that at least a part of the head main body 7 is made of a fiber-reinforced resin.

Preferably, the volume of the head maim body 7 is set in a range of not more than 470 cc, more preferably not more than 460 cc to satisfy the Golf Rules.

The weight member 8 is disposed in the hollow (i) of the head main body 7 to provide a more mass to the head 1.

It is not essential but preferable that the weight member 8 is made of a metallic material. The material of the weight member 8 can be determined according to the material of the head main body 7.

It is preferable that the material of the weight member 8 is the same material as the head main body 7, or a material having a greater specific gravity than that of the head main body 7. For example, stainless steel, maraging steel, titanium alloy, magnesium alloy, aluminum alloy, copper alloy, tungsten alloy or the like can be suitably used as the metal material of the weight member 8.

Figure 4:
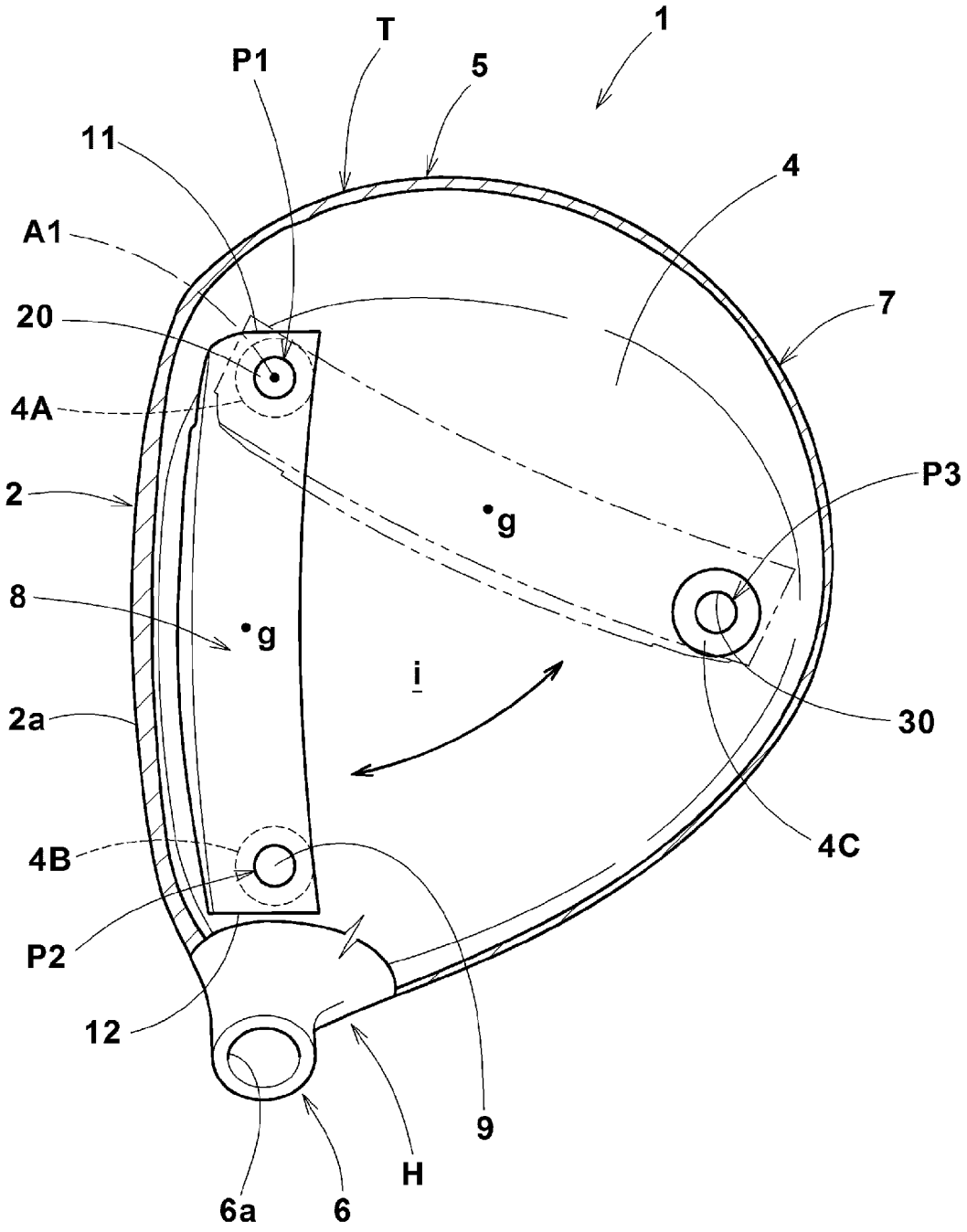
FIG. 4 is a sectional view of the golf club head taken along a horizontal plane showing the weight member moved to the second position.

The weight member 8 extends from its first end 11 to its second end 12, and preferably it is formed in the shape of a bar longer in the direction from the first end 11 to the second end 12 as shown in FIGS. 3 and 4.

In the top view, the weight member 8 may have a straight configuration, a curved configuration or a bent configuration, while extending from the first end 11 to the second end 12.

The place where the weight member 8 is to be disposed or fixed is not essential. The weight member 8 may be fix in the crown portion 3 or the side portion 5. But, the weight member 8 is preferably disposed in or fixed to the sole portion 4 of the head main body 7 since it is possible to lower the center of gravity of the head 1. In this embodiment, therefore, the weight member 8 is disposed in the sole portion 4 of the head main body 7.

As shown in FIGS. 3 and 4, a first end 11 side point of the weight member 8 is pivotally fixed to a first position P1 of the sole portion 4 of the head main body 7 rotatably around a first axis A1 which intersects the first position P1 preferably in a substantially vertical direction.

By rotating the weight member 8 around the first axis A1, a second end 12 side point of the weight member 8 can be moved to at least a second position P2 and a third position P3 of the head main body 7 which positions are on the locus described by the first end 11 side point during rotating.

The second end 12 side portion of the weight member 8 can be fixed to any of the above-mentioned at least two positions P2 and P3 by the use of a fixing member 9.

The fixing member 9, for example, a screw member, which is capable of fixing the second end 12 side portion to the head maim body 7 (the sole portion 4) by working from the outside of the head, can be suitably used although it is not limited thereto.

The first end 11 side portion of the weight member 8 can be rotated about the first axis A1 within the hollow (i) of the head main body 7, and thereby the second end 12 side portion can be fixed to the second position P2 or the third position P3 alternatively. Accordingly, the weight member 8 rotated about the first axis A1 can change the position of its center g of gravity relatively to the head main body 7.

When the weight member 8 is rod-shaped as in this embodiment, its center g of gravity occurs relatively far from the first axis A1, therefore, the position of the center of gravity of the head 1 can be changed largely by rotating the weight member 8 about the first axis A1.

Figure 2:
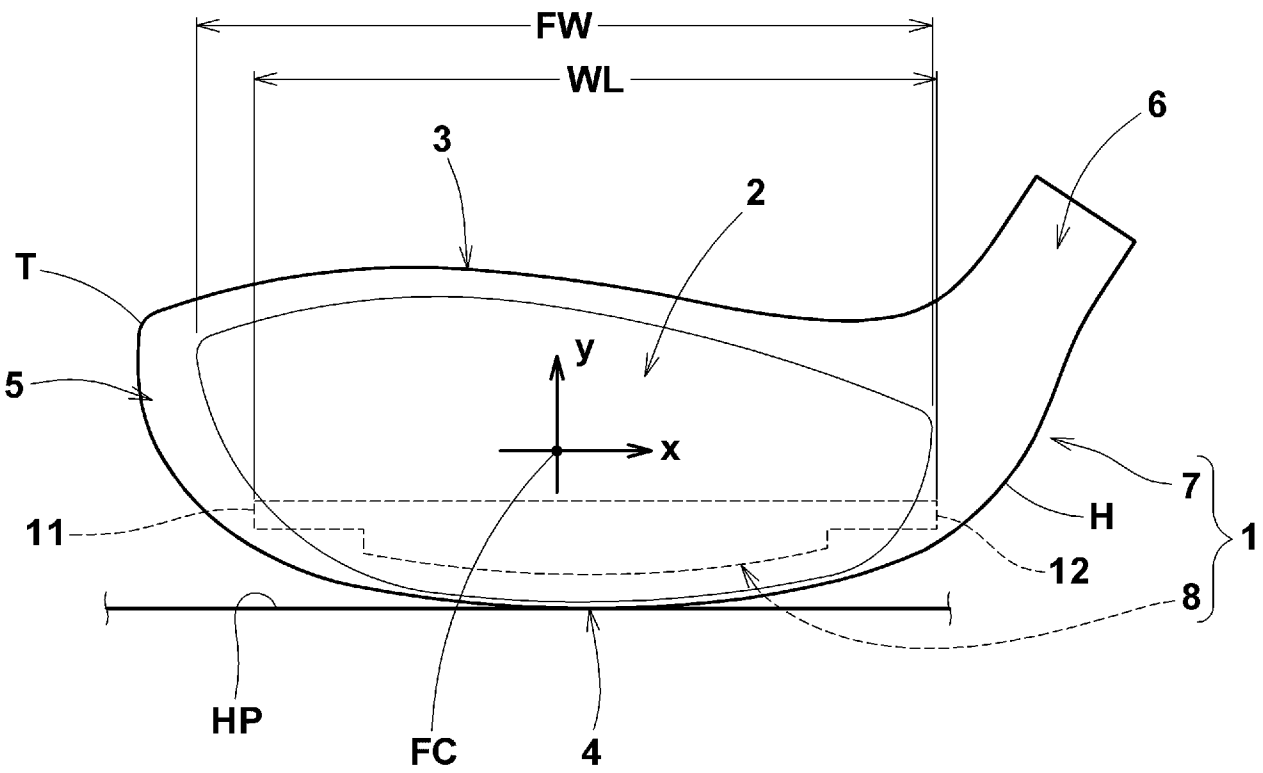
FIG. 2 is a front view of the golf club head.

Thus, it is preferable that, as shown in FIG. 2, the length WL of the weight member 8 measured in the toe-heel direction from the first end 11 to the second end 12 is not less than 70%, more preferably not less than 80%, still more preferably not less than 85% of the length FW of the face 2*a* measured in the toe-heel direction.

Since the weight member 8 is placed within the hollow (i) of the head main body 7, its influence on the appearance of the sole can be reduced. Further, there is no possibility of the durability being deteriorated by direct contact of the weight member 8 with the ground during swing.

As shown in FIG. 4, the third position P3 is located backward of the second position P2. Accordingly, when the second end 12 side portion of the weight member 8 is fixed to the third position P3 (hereinafter, referred to as the "state fixed to the third position"), the position of the center g of gravity of the weight member 8 is shifted toward the rear of the head, and the center of gravity of the head becomes deeper, and when the second end 12 side portion of the weight member 8 is fixed to the second position P2 (hereinafter, referred to as the "state fixed to the second position"), the position of the center g of gravity of the weight member 8 is shifted toward the front side of the head, and the center of gravity of the head becomes shallower. Therefore, the position of the center of gravity of the head 1 can be adjusted, for example, according to players' play styles and characteristics of golf club swing.

In this embodiment, the first position P1 is provided in a toe T side, the second position P2 is provided in a heel H side, and the third position P3 is provided between the first position P1 and the second position P2 in the toe-heel direction. Preferably, the first position P1 and the second position P2 are set such that, as shown in FIG. 4, in the state fixed to the second position, the longitudinal direction of the weight member 8 extends substantially in the toe-heel direction along the face 2*a*. Accordingly, it is possible to minimize the depth of the center of gravity of head 3.

In the state fixed to the second position, the depth L1 of the center G of gravity of the head 1 becomes shallow, therefore, the head 1 can provide low spin to the ball as preferred by the advanced golf players.

In order to more effectively derive this effect, the depth L1 of the center G of gravity of the head in the state fixed to the second position, is preferably not more than 29 mm, more preferably not more than 28 mm, still more preferably not more than 27 mm.

Figure 7A:
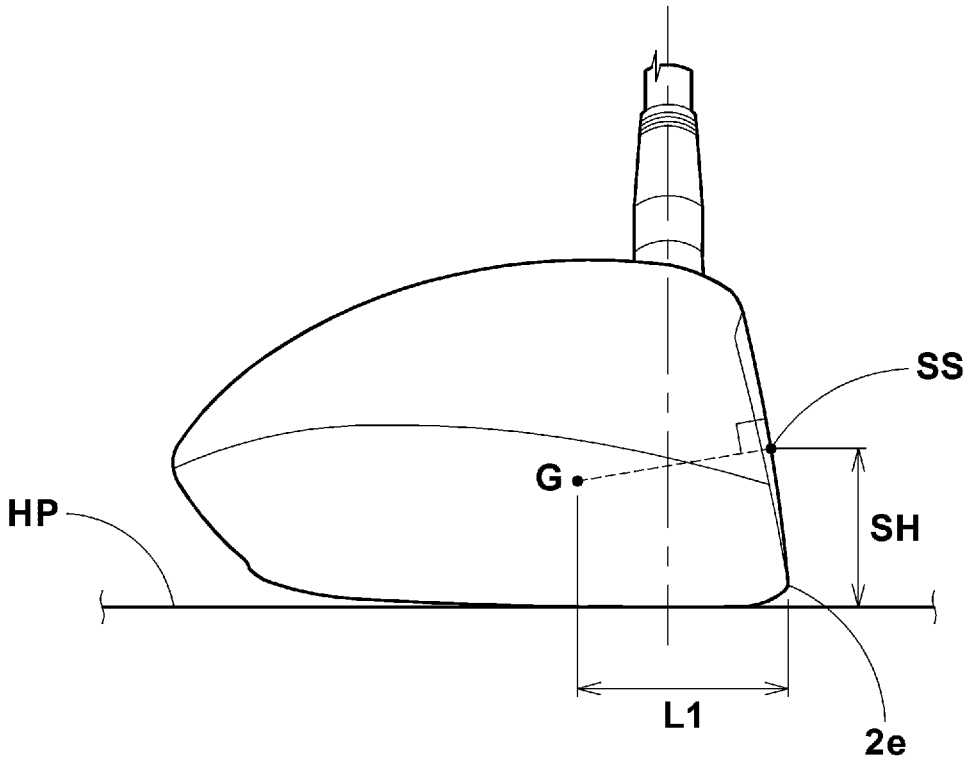
FIGS. 7(A) and 7(B) are a side view and a front view of the golf club head under its standard state, respectively, for explaining the specifications of the head.

Here, the depth L1 of the center of gravity is, as shown in FIG. 7(A), a horizontal distance from the leading edge 2*e* of the head to the center G of gravity.

Figure 7B:
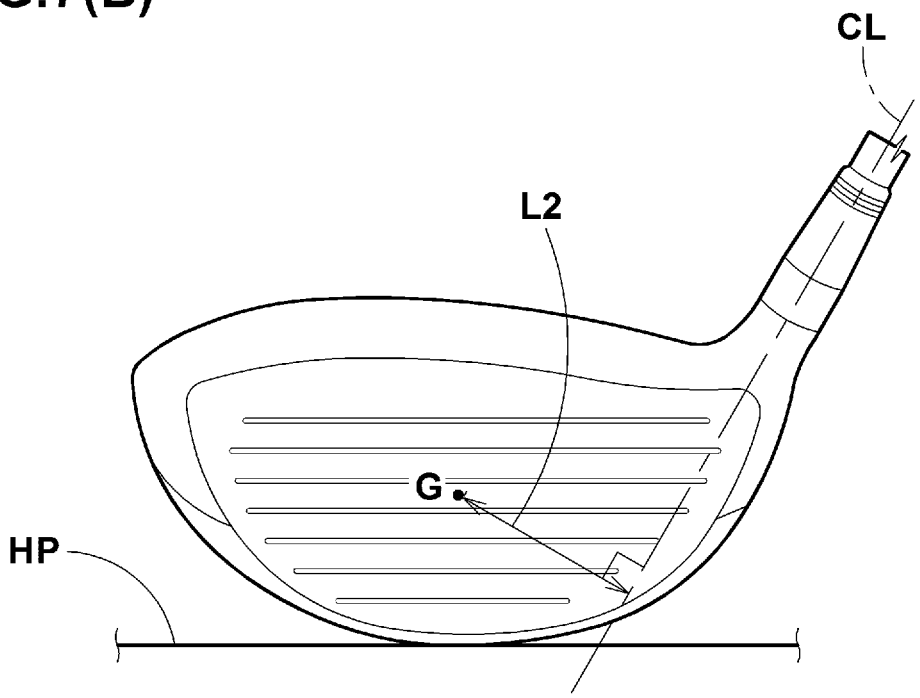

In the state fixed to the second position, it is possible to relatively reduce the distance L2 of the center G of gravity from the central axis CL of the club shaft measured perpendicularly thereto as shown in FIG. 7(B) (hereinafter, the CG distance).

If the CG distance is small, there is an advantage such that it becomes easy to return the head 1 during swing, and thereby it is easy to grasp the ball. Therefore, in order to more effectively derive such effects, the CG distance in the state fixed to the second position, is preferably not more than 33 mm, more preferably not more than 32 mm, still more preferably not more than 31 mm.

In the state fixed to the third position, the depth of the center G of gravity of the head 1 becomes deep, therefore, the head 1 can provide a relatively wide sweet spot area as well as a higher launch angle to the ball as preferred by the average golf players. Thus, a directional stability of the hit ball and a long carry distance may be provided for the average golfer. In order to more effectively derive such effects, the depth of the center G of gravity of the head 1 in the state fixed to the third position, is preferably not less than 30 mm, more preferably not less than 31 mm, still more preferably not less than 32 mm.

It is preferable that the adjustable range, namely, the difference in the depth of the center G of gravity of the head 1 between the state fixed to the second position and the state fixed to the third position, is preferably not less than 3 mm, more preferably not less than 4 mm, still more preferably not less than 5 mm.

In the state fixed to the third position, the CG distance can be prevented from becoming too small.

In the head 1 in this embodiment, the CG distance is adequately decreased in the state fixed to the second position.

If the CG distance is yet reduced, there is a tendency that the head is returned excessively during swing (the ball is grasped excessively), and the ball tends to deflect from the target trajectory, for example, to the left in the case of a right-handed golfer.

In the head 1 in this embodiment, therefore, the weight member is configured such that, when the weight member is in the state fixed to the third position, the center g of gravity of the weight member shifts toward the backward and the toe of the head so that the CG distance becomes larger than that in the state fixed to the second position.

The movable weight member 8 described above can be embodied into various forms by the use of conventional techniques. Hereinafter, some embodiments will be described more specifically, but the specific embodiments should not be construed as to limit the scope of the present invention.

Figure 8:
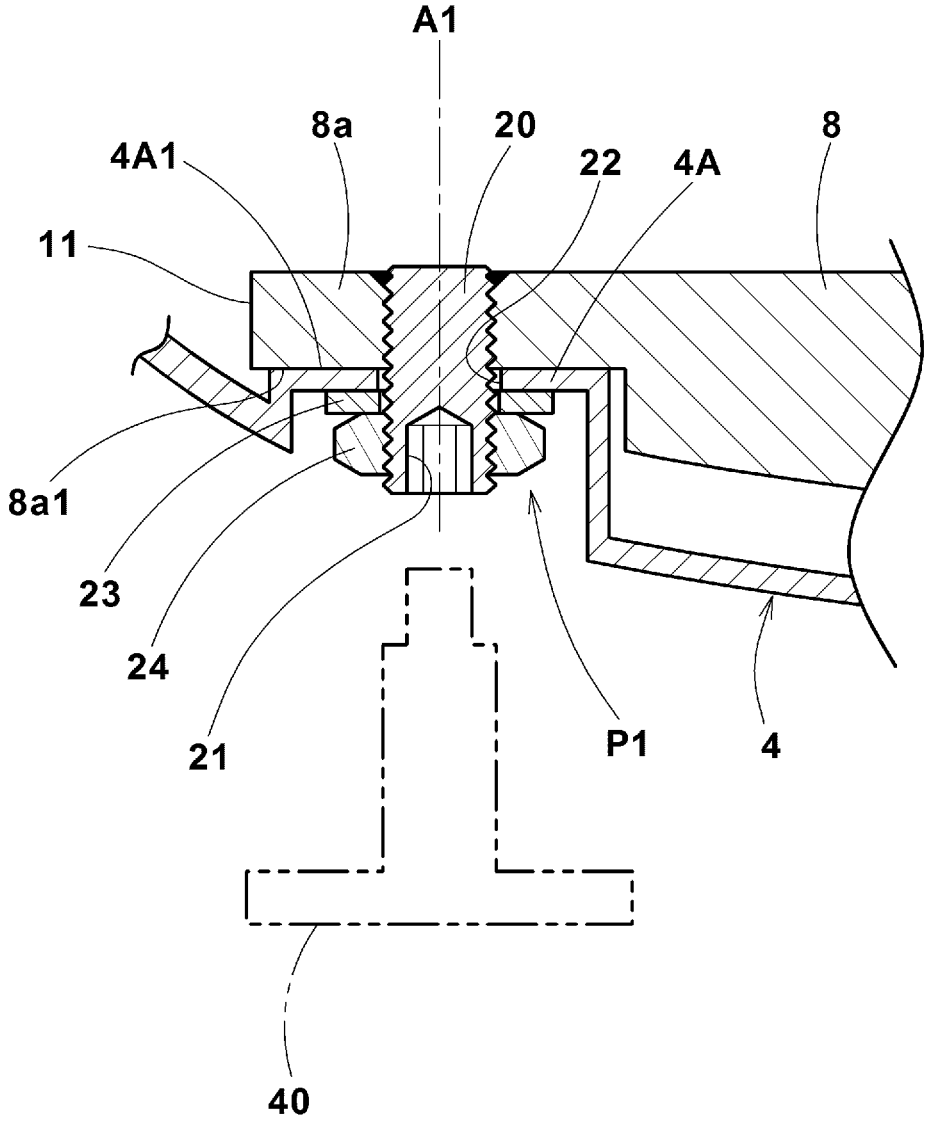
FIG. 8 is a closeup showing a toe side part (first position) of FIG. 3.

FIG. 8 shows the vicinity of the first position P1 shown in FIG. 3.

In the embodiment shown in FIG. 8, the weight member 8 is provided in a first end 11 side portion with a thin part 8*a* whose thickness is less than that in a central part 8*c* of the weight member 8.

The thin part 8*a* has a substantially flat bottom surface 8*a*1, and the bottom surface 8*a*1 preferably includes a horizontal surface.

Further, the weight member 8 is provided in the first end 11 side portion with a downwardly extending threaded shaft 20. The threaded shaft 20 protrudes downward from the bottom surface 8*a*1 of the thin part 8*a*.

The threaded shaft 20 can be formed integrally with the weight member 8 or fixed thereto so as not to rotate relatively to the weight member 8.

On the other hand, the sole portion 4 is provided at the first position P1 with a first mount part 4A for supporting the first end 11 side portion of the weight member 8.

The first mount part 4A protrudes from the inner surface of the head into the hollow (i) in the form of a substantially circular cylinder for example, and the first mount part 4A dents from the outer surface of the head.

The first mount part 4A has a substantially horizontal upper surface 4A1. In the upper surface 4A1, a first hole 22 penetrating through the sole portion 4 is formed concentrically with the above-mentioned first axis A1.

On the upper surface 4A1 of the first mount part 4A, the first end 11 side portion of the weight member 8 is placed. More specifically, the bottom surface 8*a*1 of the thin part 8*a* of the weight member 8 is placed. And the threaded shaft 20 penetrates through the first hole 22 with small play and a part of the threaded shaft 20 is exposed to the outside of the head. To the exposed part of the threaded shaft 20, a nut 24 and a washer 23 are attached from the outside of the head 1.

Thus, the nut 24 can be loosened and tightened about the threaded shaft 20 from the outside of the head 1.

By tightening the nut 24, the first end 11 side portion of the weight member 8 can be immovably fixed to the first position P1 of the head main body 7. On the other hand, by loosening the nut 24 slightly (there is no need to completely detach it from the threaded shaft 20), the weight member 8 can be rotated about the first axis A1 as shown in FIG. 4.

In the embodiment shown in FIG. 8, the lower end surface of the threaded shaft 20 is provided with an socket 21 into which a tool 40 for rotating the weight member 8 can be inserted. For example, the tool 40 is a hand tool such as driver. After the tip of the tool 40 is inserted into the socket 21 by a person, by turning it by hand, the weight member 8 is rotated together with the threaded shaft 20. Thus, the position of the weight member 8 can be adjusted by such simple operation.

Figure 9:
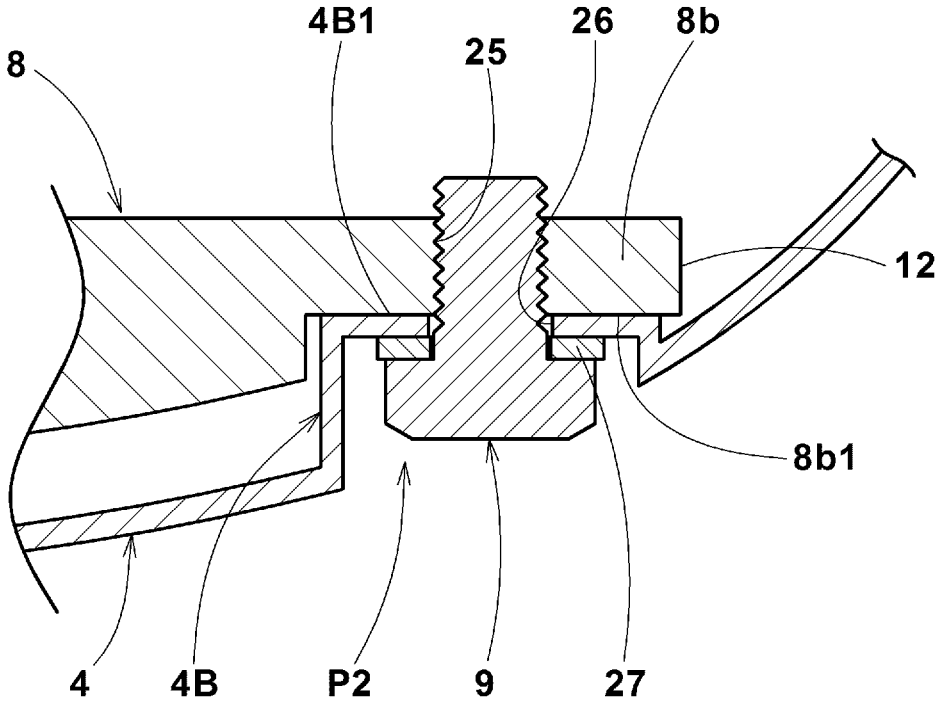
FIG. 9 is a closeup showing a heel side part (second position) of FIG. 3.

FIG. 9 shows the vicinity of the second position P2 of the weight member 8 shown in FIG. 3.

In this embodiment, the weight member 8 is provided in a second end 12 side portion with a thin part 8*b* whose thickness is less that that of the central part 8*c* of the weight member 8. The thin part 8*b* has a substantially flat bottom surface 8*b*1. The bottom surface 8*b*1 preferably includes a horizontal surface. The second end 12 side portion of the weight member 8 is provided with a screw hole 25. In this embodiment, the screw hole 25 is formed in the thin part 8*b*.

The weight member 8 in this embodiment comprises the thick central part 8*c*, the thin part 8*a* on the first end 11 side, and the thin part 8*b* on the second end 12 side.

In such weight member 8, a substantially central position in the length direction, serves to provide a larger mass.

It is preferable that, as shown in FIG. 3, the central part 8*c* between the first mount part 4A and the after-mentioned second mount part 4B has a bottom surface 8*c*1 which is smoothly curved and projects toward the sole portion 4. Such weight member 8 serves to lower the center of gravity of the head 1.

The second mount part 4B is formed at the second position P2 of the sole portion 4 in order to support the second end 12 side portion of the weight member 8 in this example. The second mount part 4B protrudes into the hollow (i) from the inner surface of the head in the form of a substantially circular cylinder for example, and the second mount part 4B dents from the outer surface of the head.

The second mount part 4B has a upper surface 4B1 which is substantially horizontal in this example.

In the upper surface 4B1, a second hole 26 which penetrates through the sole portion 4 is formed.

In FIG. 9, there is shown the vicinity of the second position P2 in the state fixed to the second position.

The fixing member 9 in this example is a screw (male screw), and the screw with a washer 27 penetrates through the second hole 26 and is fastened into the screw hole 25 of the weight member 8.

By tightening the fixing member 9, the second end 12 side portion of the weight member 8 is immovably fixed to the head main body 7 at the second position P2.

Since the first end 11 side portion and the second end 12 side portion of the weight member 8 are fixed to the head main body 7, the weight member 8 can be prevented from being dislocated by the impact when hitting the ball with the face 2*a*.

If the user want to get the state fixed to the third position, the fixing member 9 on the second end 12 side of the weight member 8 is loosened and completely detached from the weight member 8 (first step), and the nut 24 on the first end 11 side of the weight member 8 is loosened slightly (second step). On this occasion, there is no need to completely detach the nut 24 from the threaded shaft 20. Needless to say, it is possible to perform either the first step or the second step first, whichever is convenient.

Then, by rotating the threaded shaft 20 with the tool 40 engaged with the socket 21, the weight member 8 is rotated about the first axis A1 within the hollow (i) of the head 1, and the second end 12 side portion of the weight member 8 can be moved to the second position P2 (third step).

Figure 5:
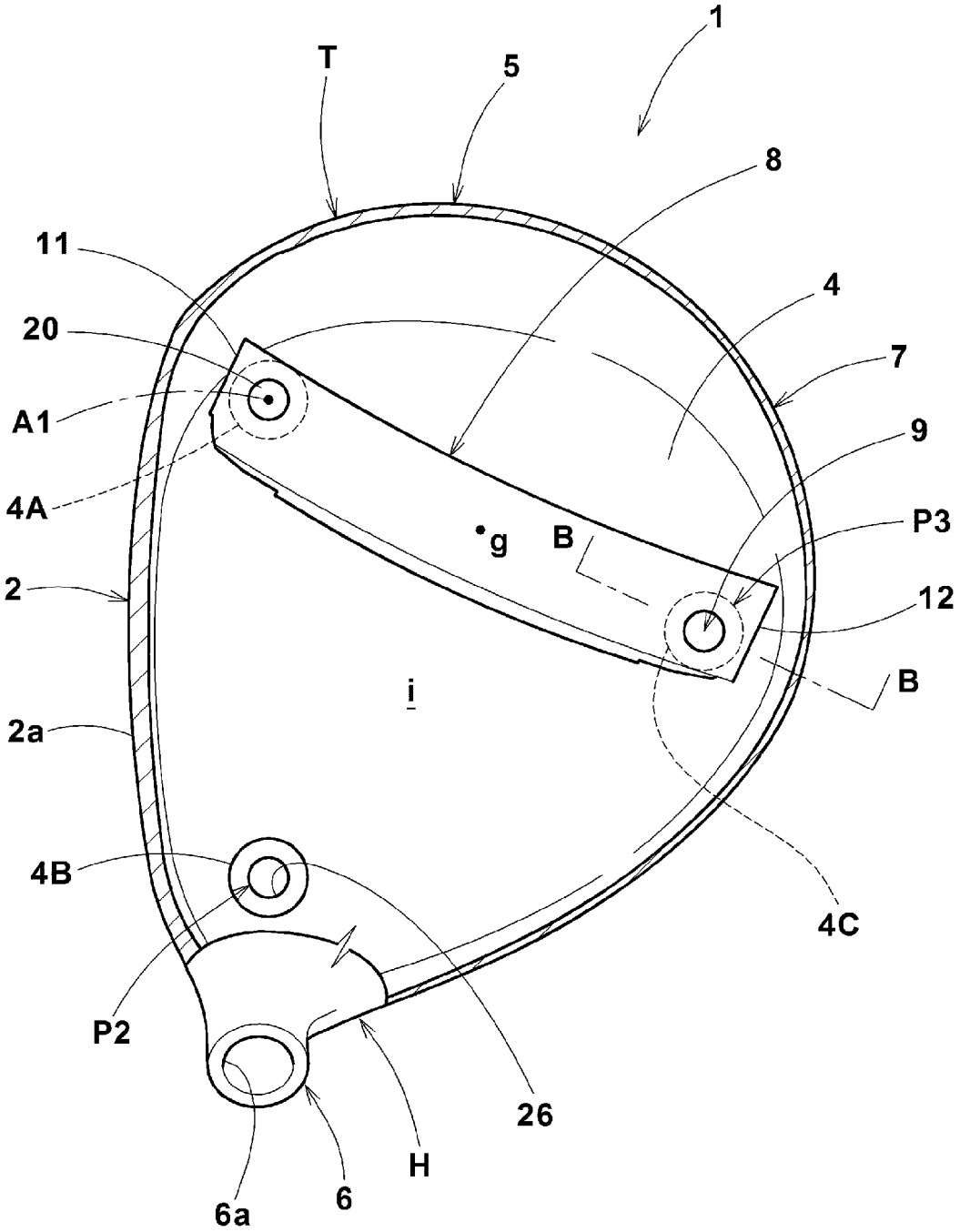
FIG. 5 is a sectional view of the golf club head taken along the horizontal plane showing the weight member moved to the third position.
Figure 6:
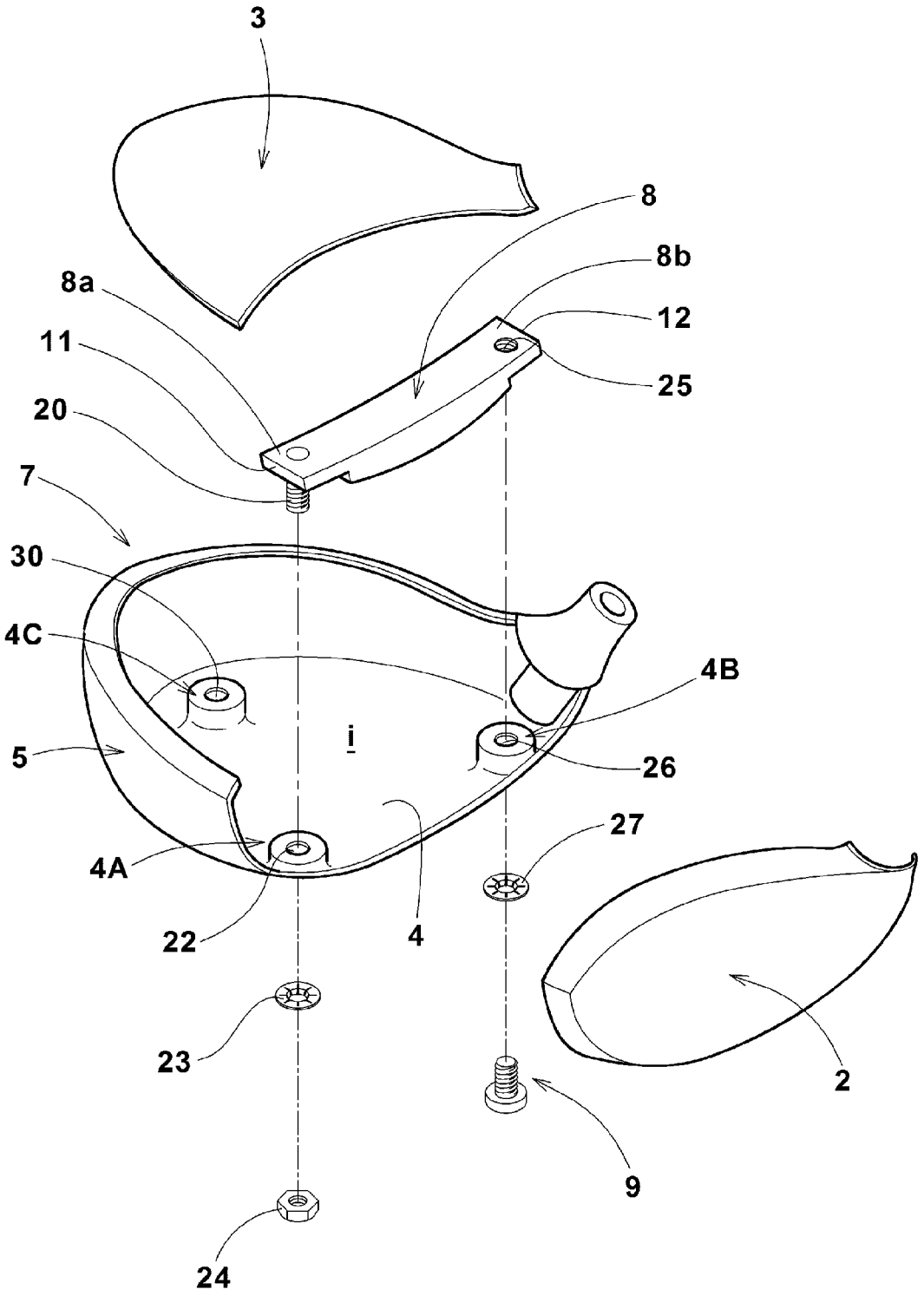
FIG. 6 is an exploded perspective view of the golf club head.
Figure 10:
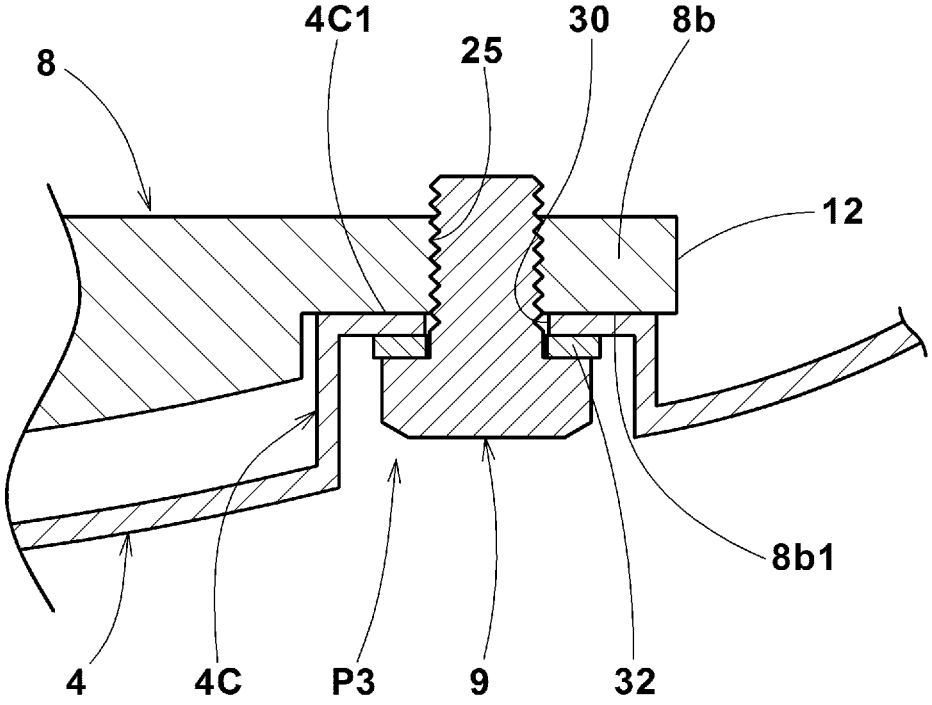
FIG. 10 is an enlarged cross-sectional view taken along line B-B of FIG. 5.

In FIG. 10, there is shown the vicinity of the third position in the state fixed to the third position (corresponding to the BB cross-section of FIG. 5).

As shown, the sole portion 4 of the head main body 7 is provided at the third position P3 with a third mount part 4C in order to support the second end 12 side portion of the weight member 8 moved to the third position P3.

The third mount part 4C protrudes into the hollow (i) from the inner surface of the head in the form of a substantially circular cylinder for example, and the third mount part 4C dents from the outer surface of the head.

The third mount part 4C has a upper surface 4C1 which is substantially horizontal in this example.

On the upper surface 4C1, the second end 12 side portion of the weight member 8 is placed. More specifically, the bottom surface 8*b*1 of the thin part 8*b* of the weight member 8 is placed. It is preferred that the upper surface 4B1 of the second mount part 4B and the upper surface 4C1 of the third mount part 4C are included in the same plane. Accordingly, the weight member 8 can secure a sufficient contact area with each of the mount portions 4A to 4C, therefore, both end portions of the weight member 8 can be secured stably.

In the third mount part 4C, a third hole 30 as a through hole is formed substantially concentrically with the screw hole 25.

The fixing member 9 which has been detached previously together with the washer 32 for example, is penetrated through the third hole 30 and fastened to the screw holes 25 from the outside of the head 1. Thus, the fixing member 9 can be utilized to fasten the second end 12 side portion of the weight member 8 at the second position P2 as well as at the third position.

By tightening the fixing member 9, the second end 12 side portion of the weight member 8 is immovably fixed to the head main body 7 at the third position P3 (Fourth step).

After the fourth step, the nut 24 on the first end 11 side of the weight member 8 is tightened (Fifth step).

Needless to say, it is possible to perform either the fourth step or the fifth step first, whichever is convenient.

Through the above steps, the second end 12 side portion of the weight member 8 can be moved from the second position P2 to the third position P3.

Needless to say, it is possible to move the second end 12 side portion of the weight member 8 from the third position P3 to the second position P2 by performing similar steps to the above.

Figure 11:
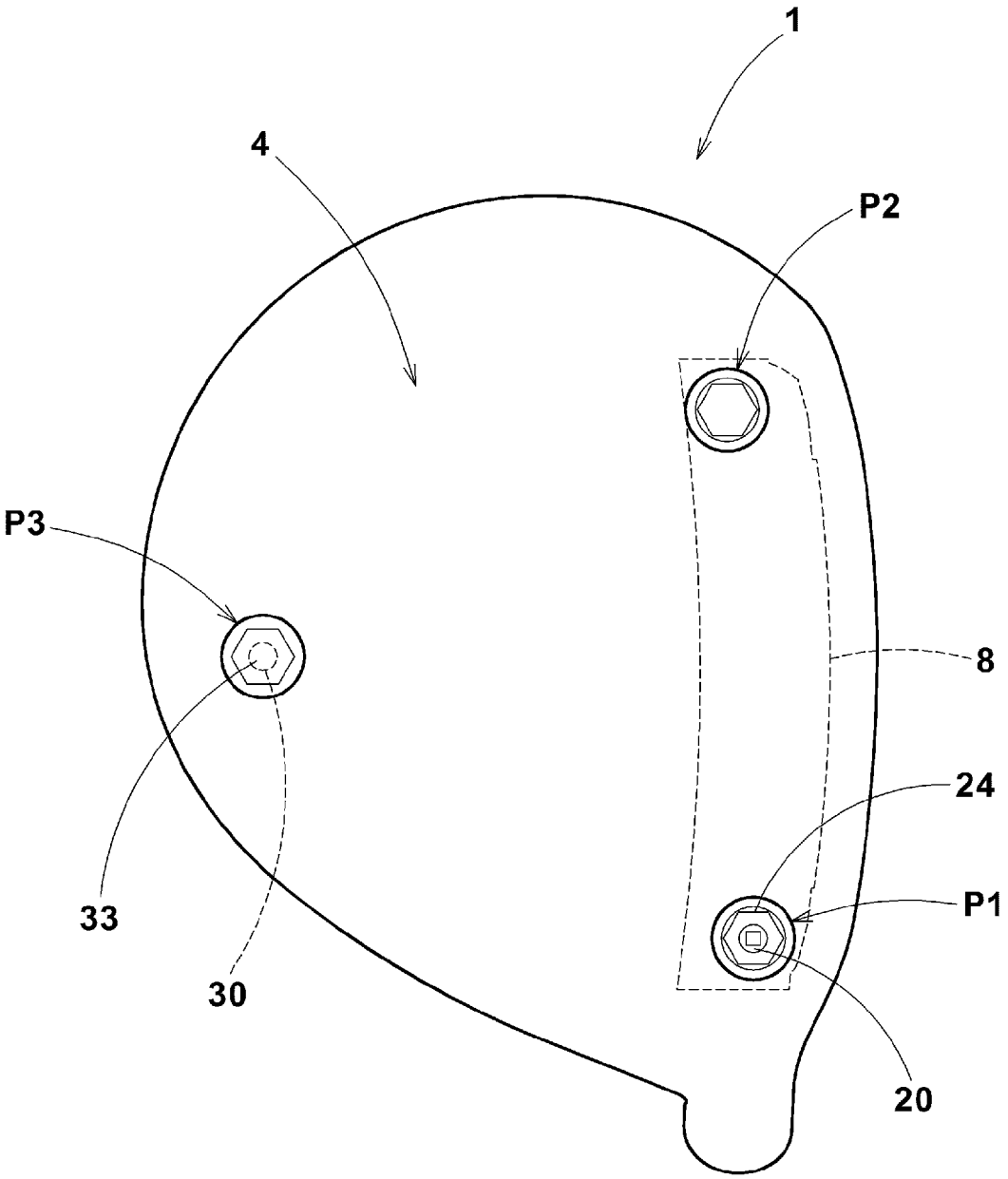
FIG. 11 is a bottom view of the golf club head.

FIG. 11 is a bottom view of the head 1 in the state fixed to the second position.

In the state fixed to the second position, the third hole 30 at the third position P3 of the sole portion 4 is preferably closed by a closing member 33 such as blind cover and dummy screw.

Similarly, in the state fixed to the third position, the second hole 26 at the second position P2 of the sole portion 4 is preferably closed by a closing member 33 such as blind cover and dummy screw.

Thus, degradation of the appearance of the head 1 can be prevented.

Figure 12:
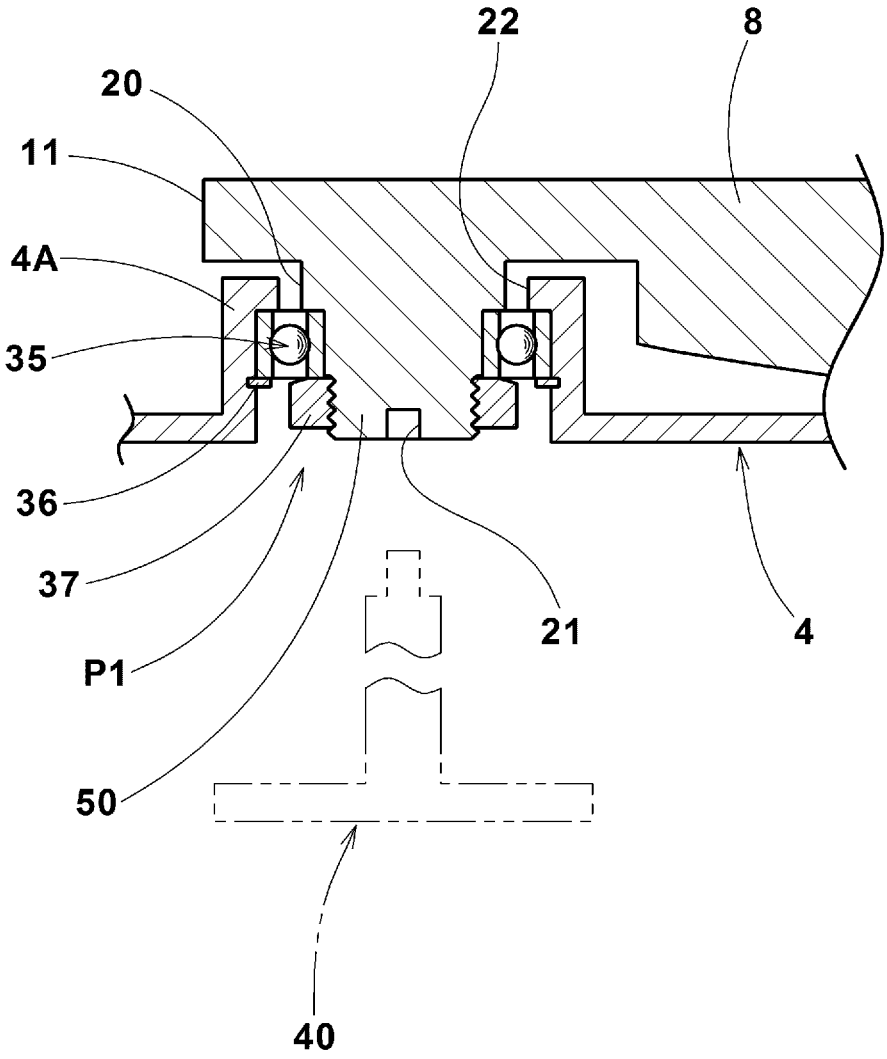
FIG. 12 is a cross-sectional view showing a first position of another embodiment of the present invention.

FIG. 12 shows a structure in the vicinity of the first end 11 of the weight member 8 as a modification of the structure shown in FIG. 8.

In the former structure shown in FIG. 8, the first end 11 of the weight member 8 is immovably fixed by tightening the nut 24 after adjusting the center of gravity of the head.

In this structure shown in FIG. 12, the first end 11 of the weight member 8 is supported at the first position P1 to be always rotatable (not fixed).

The first end 11 side portion of the weight member 8 is provided with a downwardly projecting shaft 50.

Between the shaft 50 and the first mount part 4A, a bearing member 35 is disposed.

For example, on the first mount part 4A side, the bearing member 35 is secured between an upper flange of the first mount part 4A and a retaining ring 36 attached to the first mount part 4A. On the shaft 50 side, the bearing member 35 is secured between a nut 37 fitted to a lower end portion of the shaft 50 and a stepped portion of the shaft 50. Thus, the first end 11 side portion of the weight member 8 is always rotatably supported around the first axis A1.

In this structure, it is possible to omit the loosening and tightening of the nut 24 (the above-mentioned second step and fifth step) when moving the weight member 8 from the second position P2 to third position P3 and vice versa, therefore, the adjustment of the weight member 8 position can be further facilitated.

Incidentally, a sleeve member or the like may be used instead of the bearing member 35.

WORKING EXAMPLE

A wood type golf club head having the structure shown in FIGS. 1 to 6 was experimentally manufactured, and measured for the position of the center of gravity of head and the like. The principal specifications of the head were as follows.

head volume: 180 cc
head main body's material: stainless steel (Custom 450)
head main body's specific gravity: 7.76
weight member's material: stainless steel (Custom 450)
weight member's specific gravity: 7.76
weight member's mass: 41 grams The position (x, y coordinate values) of the center of gravity of the head was measured under the standard state, wherein the origin of the x, y coordinate was set at the face center FC, the x axis was taken along the toe-heel direction with plus values on the heel side, and the y axis was taken along the vertical direction with plus values on the crown side in the front view of the head as shown in FIG. 2.

Further, the head was measured for the sweet spot height SH as the vertical distance from the horizontal plane HP to the sweet spot ss, the depth L1 of the center G of gravity as the horizontal distance between the center G of gravity and the leading edge 2*e* of the head, and the CG distance L2 as the shortest distance between the center G of gravity of the head and the central axis CL of the shaft as shown in FIG. 7(A) and FIG. 7(B).

Furthermore, the head was measured for the vertical moment of inertia around a horizontal axis extending in the toe-heel direction though the center of gravity of the head, and the lateral moment of inertia around a vertical axis passing in the vertical direction through the center of gravity of the head.

The results are shown in Table 1.

TABLE 1

| | position of center of gravity (mm) | | sweet spot height | CG distance | depth of center of gravity | moment of inertia (g sq. cm) | |
|---|---|---|---|---|---|---|---|
| | x | y | (mm) | (mm) | (mm) | lateral | vertical |
| A: state fixed to second position (FIG. 4) | 2.7 | 6.3 | 22.8 | 30.3 | 26.3 | 2661.1 | 1264.1 |
| B: state fixed to third position (FIG. 5) | −0.6 | 8.3 | 24.8 | 35.1 | 32.5 | 2580.0 | 1369.6 |
| difference A − B | 3.3 | −2 | −2 | −4.8 | −6.2 | 81.1 | −105.5 |

From the measured results, it was confirmed that the head according to the present invention can be largely changed in the position of the center of gravity between the state fixed to the second position and the state fixed to the third position.

While detailed description has been made of preferable embodiments of the present invention, the illustrated embodiment should not be construed as to limit the scope of the present invention; various modifications are possible without departing from the scope of the present invention.

For example, the head main body 7 can be modified such that the crown portion 3 or the sole portion 4 is removably attached to the rest of the head main body by the use of a fastener such as screws.

In this case, therefore, by utilizing an opening formed by the removed crown portion 3 or sole portion 4, it is possible to replace the weight member 8 by another one or to move the position of the weight member 8.

Further, in this case, it is also possible to modify the weight member 8 such hat the weight member 8 includes a movable subsidiary weight member disposed thereon so as to be able to move it by removing the crown portion 3 or sole portion 4.

DESCRIPTION OF THE REFERENCE NUMERALS

1 golf club head
2a face
4 sole portion
7 head main body
8 weight member
11 first end of weight member
12 second end of weight member
i hollow
P1 first position
P2 second position
P3 third position

The invention claimed is:

1. A golf club head comprising:

a head main body that has a hollow interior and includes a face for striking a ball, a crown portion, a sole portion, a side portion and a hosel portion which constitute an outer shell part of the head enclosing the hollow interior, a weight member disposed within the hollow interior and having a first end and a second end, wherein a first end side portion of the weight member is secured to a first position of the head main body rotatably around a first axis intersecting the sole portion at the first position so that a second end side portion of the weight member is movable to a second position and a third position of the head main body wherein said second position and said third position are on a locus described by the first end side portion of the weight member during rotating about said first axis, and a fastener for fixing the second end side portion of the weight member to either the second position or the third position of the head main body so that the weight member is fixed to the sole portion, wherein the sole portion is provided with a first hole, a second hole and a third hole each penetrating through the sole portion, and formed at the first position, the second position and the third position, respectively, and said fastener is a screw penetrating the second hole or the third hole.

2. The golf club head according to claim 1, wherein said first end side portion of the weight member is secured to the sole portion by a second screw penetrating the first hole.

3. The golf club head according to claim 2, wherein the fastener is capable of being tightened and loosened from outside of the head at each of said second and third positions.

4. The golf club head according to claim 2, wherein the second position is located on a face portion side of the third position.

5. The golf club head according to claim 2, wherein in a toe-heel direction of the head, the first position is located on a toe side of the third position, and the second position is located on a heel side of the third position.

6. The golf club head according to claim 2, wherein the second screw is unrotatably fixed to said first end side portion of the weight member so that the weight member can be rotated within the hollow interior by rotating the second screw from outside of the head.

7. The golf club head according to claim 1, wherein the fastener is capable of being tightened and loosened from outside of the head at each of said second and third positions.

8. The golf club head according to claim 7, wherein the second position is located on a face portion side of the third position.

9. The golf club head according to claim 7, wherein in a toe-heel direction of the head, the first position is located on a toe side of the third position, and the second position is located on a heel side of the third position.

10. The golf club head according to claim 1, wherein the second position is located on a face portion side of the third position.

11. The golf club head according to claim 10, wherein in a toe-heel direction of the head, the first position is located on a toe side of the third position, and the second position is located on a heel side of the third position.

12. The golf club head according to claim 1, wherein in a toe-heel direction of the head, the first position is located on a toe side of the third position, and the second position is located on a heel side of the third position.

13. The golf club head according to claim 12, wherein when the second end side portion is fixed to the second position, the longitudinal direction of the weight member lies in a direction along the face.

* * * * *